US005490905A

United States Patent [19]

Huovila et al.

[11] Patent Number: 5,490,905

[45] Date of Patent: Feb. 13, 1996

[54] METHOD IN THE REGULATION OF A MULTI-LAYER HEADBOX AND A MULTI-LAYER HEADBOX

[75] Inventors: Jyrki Huovila, Muurame; Petri Nyberg; Michael Odell, both of Jyväskylä, all of Finland

[73] Assignee: Valmet Paper Machinery, Inc., Helsinki, Finland

[21] Appl. No.: 269,348

[22] Filed: Jun. 30, 1994

[30] Foreign Application Priority Data

Jul. 1, 1993 [FI] Finland ..... 933030

[51] Int. Cl.[6] ..... D21F 1/06

[52] U.S. Cl. ..... 162/212; 162/343; 162/344; 162/336; 162/123; 162/125

[58] Field of Search ..... 162/343, 344, 162/252, 336, 123, 212, 125; 366/160; 264/518

[56] References Cited

U.S. PATENT DOCUMENTS

| | | | |
|---|---|---|---|
| 4,146,425 | 3/1979 | Gutzeit | 162/252 |
| 4,198,270 | 4/1980 | Kurtz et al. | 162/343 |
| 4,640,810 | 2/1987 | Laursen et al. | 264/518 |
| 4,792,380 | 12/1988 | Tuomikoski | 162/344 |
| 5,030,326 | 7/1991 | Nous | 162/258 |
| 5,110,416 | 5/1992 | Linsuri et al. | 162/343 |
| 5,316,383 | 5/1994 | Begemann | 366/160 |

FOREIGN PATENT DOCUMENTS

| | | |
|---|---|---|
| 0418445 | 3/1991 | European Pat. Off. . |
| 0462472 | 12/1991 | European Pat. Off. . |
| 912230 | 5/1991 | Finland . |
| 4112347 | 10/1992 | Germany . |
| 4239845 | 5/1993 | Germany . |
| 4323263 | 1/1994 | Germany . |

*Primary Examiner*—David L. Lacey
*Assistant Examiner*—Calvin Padgett
*Attorney, Agent, or Firm*—Steinberg, Raskin & Davidson

[57] ABSTRACT

A method and device for the regulation of a pulp suspension flow in a multi-layer headbox and a multi-layer headbox for a paper machine/board machine. For the formation of different layers in the web, at least two pulp suspensions having different pulp concepts flow through the multi-layer headbox. The flow of a pulp suspension that forms one of the layers in the web is regulated by regulating the component flows that constitute this flow and regulating the concentration of the component flows independently from one another. In this manner, i.e., by regulating only this the particular layer, the total flow of the pulp suspension leaving the headbox is regulated.

20 Claims, 12 Drawing Sheets

METHOD IN THE REGULATION OF A MULTI-LAYER HEADBOX AND A MULTI-LAYER HEADBOX

BACKGROUND OF THE INVENTION

The present invention relates to a method in the regulation of a multi-layer headbox of a paper machine or board machine. By means of the method and the device in accordance with the invention, it is possible to reliably act upon the grammage profile of the paper across the width of the paper web and also to act upon the fiber orientation profile in the paper web across the width of the paper web. The invention also relates to a multi-layer headbox of a paper machine or board machine.

In a multi-layer headbox, pulps of different sorts in the vertical direction are fed in different layers. One or both of the faces of the paper or board formed out of the jet of the headbox are made representative by using, e.g., high-cost and bleached pulp with a high content of fillers. In a three-layer structure, the middle layer is used to constitute the strength and rigidity of the paper/board, whereas the surface layers hide the less expensive and coarser raw-material in the middle of the structure.

In a multi-layer headbox, when the grammage is regulated conventionally by profiling the shape of the slice, all the layers are affected at the same time, including the covering surface layers. In such a case, the coverage by the surface material is changed in the regulated area and leaves a striped appearance in the product. The profile-bar construction produces turbulence in the jet and deteriorates the purity of the layers.

As is known from the prior art, the direction of the discharge jet of the pulp suspension discharged out of the headbox should differ from the machine direction as little as possible. A directional angle of the discharge jet that differs from the machine direction, which produces distortion of the fiber orientation, has a clear effect on the quality factors of the paper, such as the anisotropy of strength and stretch. The level and variation of anisotropy in the transverse direction also affect the printing properties of paper, such as moisture expansion. In particular, it is an important requirement that the main axes of the directional distribution, i.e. orientation, of the fiber mesh in the paper coincide with the directions of the main axes of the paper and that the orientation is symmetric in relation to these axes.

At the edges of the pulp-flow duct in the headbox, owing to the vertical walls, there is a higher friction. This edge effect produces a very strong linear distortion in the profile. Profile faults in the turbulence generator of the headbox usually produce a non-linear distortion in the profile inside the lateral areas of the flow ducts.

Attempts are made to compensate for an unevenness of the grammage profile arising from the drying-shrinkage of paper/board by means of a crown formation of the slice, so that the slice is thicker in the middle of the pulp jet. It is a phenomenon in the manufacture of paper that when the paper/board web is dried, it shrinks in the middle area of the web to a lower extent than in the lateral areas of the web. The shrinkage is typically in the middle are of the web from about 1% to about 3% and in the lateral areas of the web from about 4% to about 6%. The shrinkage profile produces a corresponding change in the transverse grammage profile of the web so that, owing to the shrinkage, the dry grammage profile of a web whose transverse grammage profile was uniform after the press is changed during the drying so that, in both of the lateral areas of the web, the grammage is slightly higher than in the middle area. As is known from the prior art, the grammage profile has been regulated by profiling the thickness of the jet, either by means of a profile bar construction or by regulating the shape of the discharge duct so that the thickness of the jet is regulated to be larger in the middle area than in the lateral areas of the web.

By means of this arrangement, the pulp suspension is forced to move towards the middle area of the web. However, this circumstance affects the deviation-angle profile of the direction of the discharge jet, which profile further determines the distortion profile of the fiber orientation. The main axes of the directional distribution, i.e. orientation, of the fiber mesh should coincide with the directions of the main axes of the paper, and the orientation should be symmetric in relation to these axes. In the regulation arrangement that profiles the thickness of the jet, a change in the orientation is produced as the pulp suspension flow receives components in the transverse direction.

Regulation of the lip of the headbox also produces a change in the transverse flows of the pulp jet even though the objective of the regulation is exclusively to affect the grammage profile, i.e. the thickness profile of the pulp suspension layer that is fed. Thus, the transverse flows have a direct relationship with the distribution of the fiber orientation.

In the prior art, reference is also made to Finnish Patent Application No. 912230 which describes a headbox that has been divided across its width into compartments by means of partition walls and in which, in an individual compartment, there is at least one inlet duct for the passage of a component flow. Moreover, in the device described in FI 912230, a mixer is connected in front of the individual inlet duct by whose means the pulp suspension ratio can be regulated. In the device of FI 912230, it has, however, not been possible to adequately regulate the mixing ratio without a change in the flow quantity. A detailed device has not been described for carrying out the regulation nor is the device related to a multi-layer headbox.

OBJECTS AND SUMMARY OF THE INVENTION

Accordingly, it is an object of the present invention to provide novel solutions for the problems discussed above.

It is an object of the present invention to provide a new and improved method and device by whose means the pulp suspension flow discharged out of a multi-layer headbox can be regulated without a profile bar.

It is another object of the present invention to provide a new and improved method and device by whose means it is possible to regulate the consistency of the flow locally and the pressure level of said consistency-regulated flow and, thus, the overall flow quantity or rate and the flow velocity while the mixing ratio remains at a regulated, invariable value.

It is still another object of the present invention to provide a new and improved method and device by whose means it is possible to control the grammage profile of the paper/board web reliably across the entire web width, and favorably also control the fiber orientation profile of the paper/board web across the entire web width in the layer to which the regulation of the grammage is applied.

In accordance with the invention, the grammage profile is affected by regulating the pulp flow that forms one layer. The grammage profile of the remaining layers of pulp flow in the multi-layer headbox are not required to be regulated.

In the method in accordance with the invention, the flow of a pulp suspension that forms one of the layers of the web is regulated by regulating the component subflows that constitute this flow and regulating the concentrations of the component subflows independently from one another. By means of this specific regulation applied to the particular layer, the total flow of the pulp suspension leaving the headbox is regulated.

In the multi-layer headbox in accordance with the invention, for the formation of a second pulp suspension, in addition to a first pulp suspension which is directed straight from the inlet header to the slice, the device comprises a source for the introduction of a first subcomponent flow, preferably an inlet header, and at least one additional source for the introduction of a second subcomponent flow, preferably also an inlet header. A mixer unit is provided in which the combination of the subcomponent flows takes place so that, when one subcomponent flow is increased, the other subcomponent flow is reduced by the corresponding amount, and vice versa. The combined flow (subflow), which remained invariable during the regulation of the mixing ratio, is passed into the discharge duct of the headbox. The flow of the pulp suspension from the slice of the headbox is composed of several adjacent component subflows, which have been introduced at different points across the width of the multi-layer headbox, and the concentrations of these flows are regulated across the width of the web. The flow of the pulp suspension that flows out of the multi-layer headbox is thus regulated by means of the regulation of the single layer.

In a preferred embodiment of the invention, two subcomponent flows are introduced into the mixer, and the mixing ratio of these two subcomponent flows is continuously regulated so that when the throttle of the pulp flow or 0-water flow in one subcomponent-flow duct is increased, the throttle of the other subcomponent flow is reduced, and vice versa. Thus, in the regulation, the concentration of the overall pulp flow departing from the mixer is affected continuously and, yet, the quantity or rate of the overall flow is kept invariable.

Thus, it is possible to add to the pulp flow, for example, water alone, i.e. 0-water, or a diluted pulp suspension whose concentration differs, on the whole, from the concentration of the other component subflow. The combined flow constitutes the web layer.

In the prior art devices, the grammage profile was altered by acting upon the thickness profile of the jet discharged out of the headbox. However, in the device in accordance with the invention, a profiling throttle is not necessarily needed because the fiber orientation profile is regulated by means of local flows passed into different positions of width in the headbox.

In the device in accordance with the invention, the multi-layer headbox comprises separate blocks across the width of the multi-layer headbox. In these blocks, it is possible to regulate the consistencies of the flows to a desired level. For example, when the flow in the middle layer is regulated, by means of the flow it is possible to correct a fault in the grammage profile occurring in a certain width position of the web. Thus, at a specific position in the width of the headbox, it is possible to introduce a pulp suspension thicker than average or a pulp suspension more dilute than average, depending on the measured grammage profile error, so as to correct the grammage profile error. However, it is essential in the regulation of the grammage profile that, the flow quantity of the combined flow is kept invariable. Thus, during the regulation of the consistency, changes are not produced in the overall flow-velocity profile of the pulp suspension in the headbox. By means of the width-specific flows in the headbox, and by means of regulation of the consistency of these flows, the consistency of the pulp suspension is affected only at a certain, desired position of width, and thus, by means of each flow, faults occurring in the grammage profile may be corrected.

Also, in the device and method in accordance with the invention, it is possible to regulate the fiber orientation of the flow discharged out of the headbox by regulating the pressure profile of the flow to thereby regulate the velocity profile. This takes place by, in a certain layer, regulating the flow quantity of each flow along the width of the headbox independently from one another. Thus, when the fiber orientation profile is desired to be corrected, the flow velocity profile coming out of the pipe system of the turbulence generator is affected locally in the direction of width of the web. In addition, at a certain position of width of the web, locally the pressure level and thereby the flow velocity and further the flow quantity are increased or, if necessary, reduced. In this manner, it is possible to act upon local profile faults occurring in the fiber orientation of the web.

In the following, the invention will be described in detail with reference to some exemplifying embodiments of the invention illustrated in the figures in the accompanying drawing, the invention being by no means strictly confined to the details of the embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figure 1:
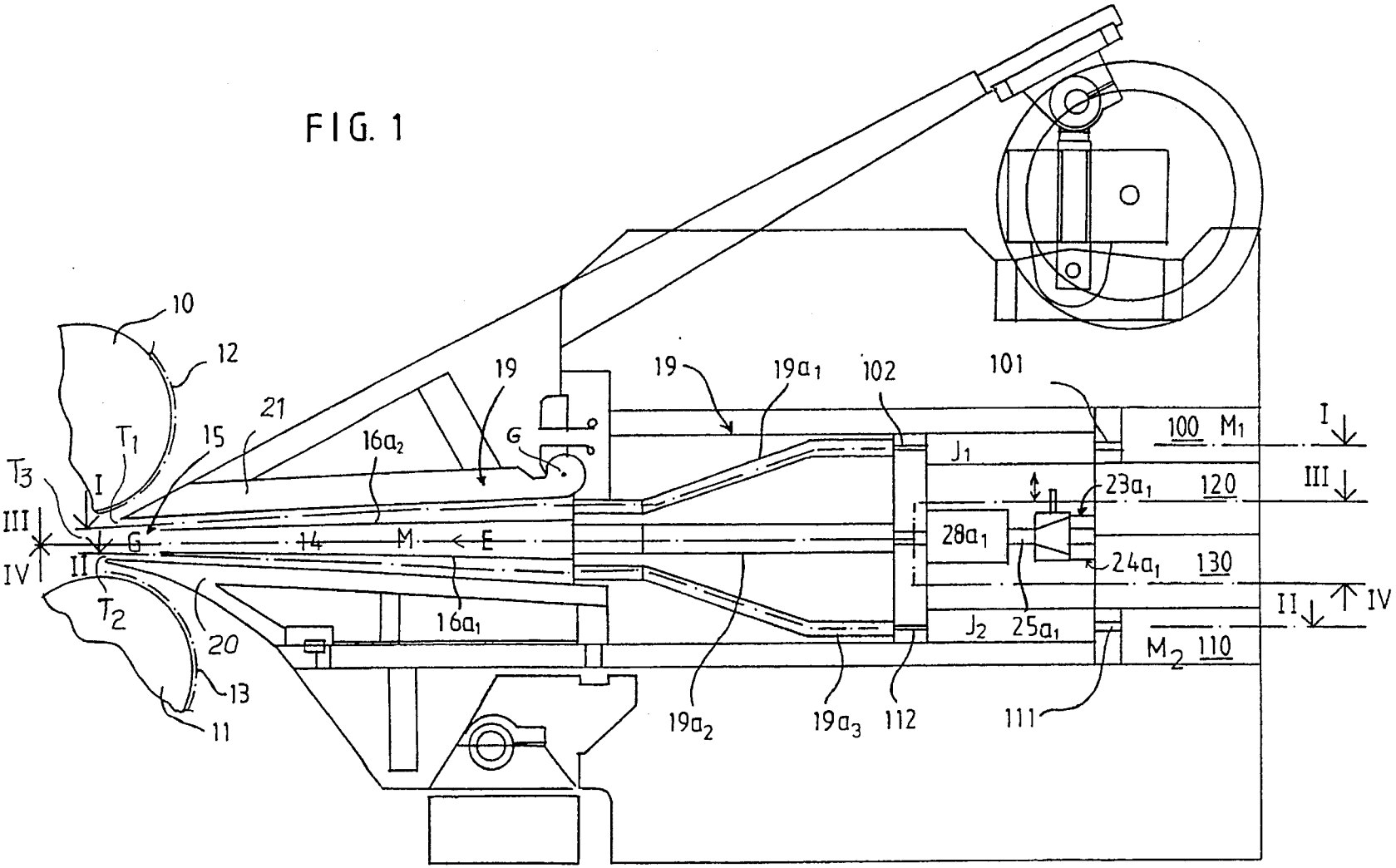
FIG. 1 is a sectional view of a multi-layer headbox of a paper machine in accordance with the invention.

FIG. 1 shows a multi-layer headbox in accordance with the invention in connection with a twin wire former. Of the former, FIG. 1 shows a pair of breast rolls 10 and 11 and forming wires 12 and 13 running over them and defining a forming gap G therebetween. A discharge duct 14 of the headbox comprises flaps $\mathbf{16}a_1,\mathbf{16}a_2$, . . . and out of the discharge duct 14 of the headbox, the pulp suspension jet is fed through the slice 15 into the forming gap G defined by the wires 12 and 13.

Proceeding in the flow direction E of the pulp suspension, the headbox comprises inlet headers 100,110,120,130, distributor manifolds, a turbulence generator 19, and a discharge duct 14. The discharge duct 14 is defined by a stationary lower-lip wall 20 and by an upper-lip wall 21 pivoting around a horizontal articulated joint G.

In the multi-layer headbox, a first pulp suspension component flow $M_1$ is passed out of the inlet header 100 through the distributor manifold 101 into an intermediate chamber $J_1$. The pulp suspension component flow is then passed further to the throttle 102 and from the throttle 102 to the turbulence generator 19, specifically into turbulence tubes $\mathbf{19}a_1$ in the turbulence generator 19.

Similarly, a second pulp suspension component flow $M_3$, whose composition may be the same as that of the first pulp suspension component flow $M_1$ or different, is brought from the inlet header 110 through the distributor manifold 111 into an intermediate chamber $J_2$. The pulp suspension component flow $M_3$ is then directed through the throttle 112 to the turbulence generator 19 into its turbulence tubes.

The third component subflows $Q_{3.1}, Q_{3.2}, \ldots, Q_{3.n}$ of a third pulp suspension component flow $M_2$ is composed of subcomponent flows $Q_{1.1}, Q_{1.2}, \ldots, Q_{1.n}$ and $Q_{2.1}, Q_{2.2}, \ldots, Q_{2.n}$. Each subcomponent flow $Q_{1.1}, Q_{1.2}, \ldots, Q_{1.n}$ is brought from the inlet manifold 120 and passed through the respective distributor pipes $\mathbf{23}a_1,\mathbf{23}a_2$, . . . into its own, separate mixer unit $\mathbf{22}a_1,\mathbf{22}a_2, \ldots, \mathbf{22}a_n$ in the direction of width of the headbox. From the other inlet header 130, the second subcomponent flow $Q_{2.1}, Q_{2.2}, \ldots, Q_{2.n}$ of the third pulp suspension component flow is passed through respective distributor pipes $\mathbf{24}a_1,\mathbf{24}a_2$, into the mixer unit $\mathbf{22}a_1$, $\mathbf{22}a_2, \ldots, \mathbf{22}a_n$. In the mixer units $\mathbf{22}a_1,\mathbf{22}a_2, \ldots, \mathbf{22}a_n$, the subcomponent flows $Q_{1.1}, Q_{1.2}, \ldots, Q_{1.n}$ and $Q_{2.1}, Q_{2.2}, \ldots, Q_{2.n}$ are mixed together to form a combined flow $Q_3$ which forms a pulp suspension component flow $M_2$ ($Q_{1.1}+Q_{1.2}$; $Q_{2.1}+Q_{2.2}$). The pulp suspension component flow $M_2$ is passed, as illustrated in FIG. 1, as the middle flow into the intermediate chambers $\mathbf{28}a_1,\mathbf{28}a_2$ . . . , which have been divided into compartments in the direction of width, or into pipes, and further into the turbulence generator 19 into the tubes $\mathbf{19}a_2$ of the turbulence generator placed in a corresponding relative height position, i.e., at substantially the same level.

The discharge duct 14 comprises flaps $\mathbf{16}a_1,\mathbf{16}a_2, \ldots, \mathbf{16}a_n$. When the pulp suspension component flows $M_1$, $M_2$ and $M_3$ are passed in the manner described above, having been divided into blocks in the vertical direction, the mixing together of the pulp suspension component flows is prevented. In addition, by means of the pulp suspension component flows $M_1$, $M_2$ and $M_3$, the web layers $T_1$, $T_2$ and $T_3$ are formed. Further, in accordance with the present invention, the component subflows $Q_{3.1},Q_{3.2}, \ldots, Q_{3.n}$ of the middle pulp suspension component flow $M_2$ are regulated in the direction of width of the paper machine by means of the mixer units $\mathbf{22}a_1,\mathbf{22}a_2, \ldots, \mathbf{22}a_n$. As a result, on the whole, the flow of the overall pulp suspension M departing from the multi-layer headbox is regulated by means of the regulation of the middle layer ($M_2$). The concept and the composition of the pulp $M_2$ differ from the composition and the concept of the pulp $M_1$ of the surface layer and preferably also from the composition and the concept of the pulp $M_3$.

Within the scope of the invention, it is, of course, possible that the multi-layer headbox comprises means for the formation of two web layers only or means for the formation of more than three web layers.

Within the scope of the invention, an embodiment of the invention is, of course, also possible in which intermediate chambers are not needed for the pulp flows $M_1$ and $M_3$. In such a case, the pulps $M_1$ and $M_3$ are made to flow out of their inlet headers directly through pipes into the turbulence generator 19.

Figure 2A:
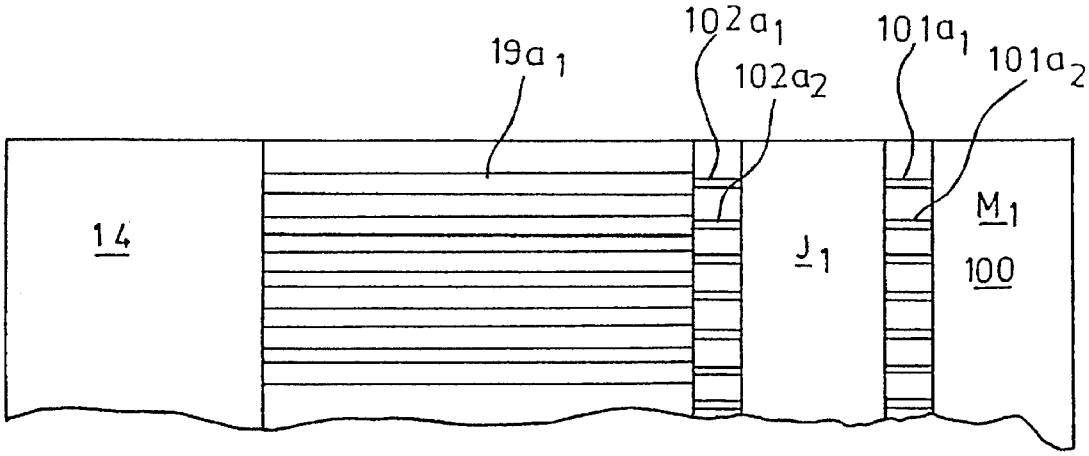
FIG. 2A is a sectional view taken along the line I—I in FIG. 1.

FIG. 2A is a sectional view taken along the line I—I in FIG. 1. As shown in FIG. 2A, the pulp $M_1$ is passed out of the inlet header 100 into distributor pipes $\mathbf{101}a_1,\mathbf{101}a_2, \ldots, \mathbf{101}a_n$ and further into the intermediate chamber $J_1$. From the chamber $J_1$, the pulp $M_1$ is passed through respective throttles $\mathbf{102}a_1,\mathbf{102}a_2, \ldots, \mathbf{102}a_n$ and further into the turbulence generator 19 into its turbulence tubes $\mathbf{19}a_1$. From the turbulence tubes, the pulp $M_1$ flows into the discharge duct 14 and is not mixed with the other pulp layers $M_2$,$M_3$.

Figure 2B:
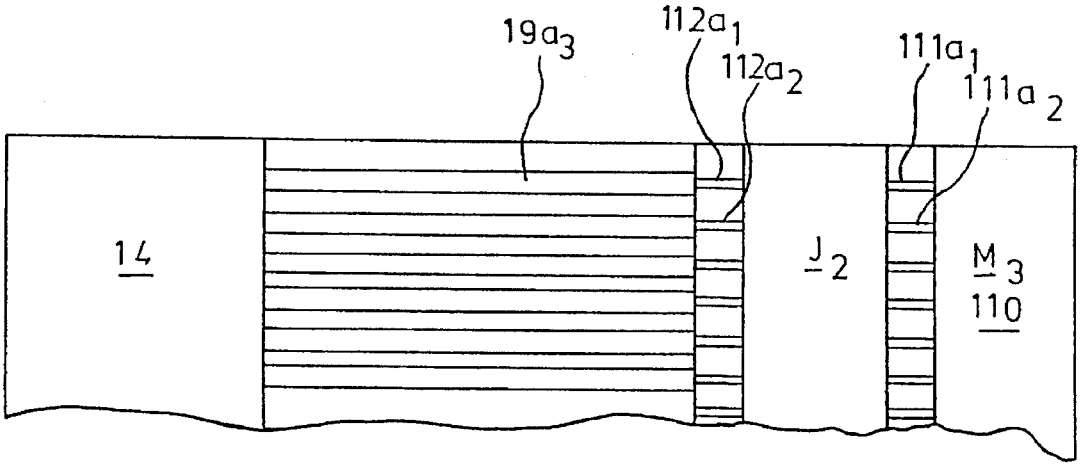
FIG. 2B is a sectional view taken along the line II—II in FIG. 1.

FIG. 2B is a sectional view taken along the line II—II in FIG. 1. The sectional view of FIG. 2B corresponds to the sectional view in FIG. 2A because the arrangement of introduction of the pulp $M_3$ is similar to that of the pulp $M_1$. The pulp $M_3$ is passed from the inlet header 110 into the distributor pipes $\mathbf{111}a_1,\mathbf{111}a_2$, . . . and further into the intermediate chamber $J_2$. From the chamber $J_2$, the pulp $M_3$ is passed through the throttles $\mathbf{112}a_1,\mathbf{112}a_2$, . . . and further into the turbulence generator 19 into its turbulence tubes $\mathbf{19}a_3$ and then into the discharge duct 14.

Figure 2C:
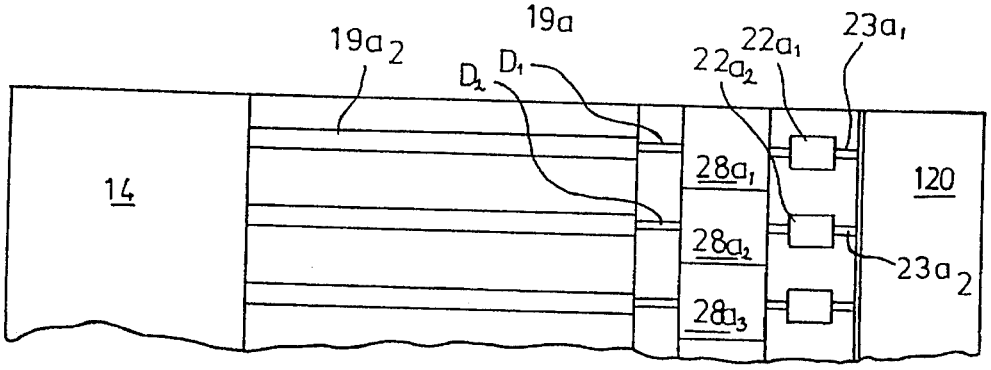
FIG. 2C is a sectional view taken along the line III—III in FIG. 1.

FIG. 2C is a sectional view taken along the line III—III in FIG. 1. As shown in FIG. 2C, the subcomponent flow $Q_1$, which is preferably a diluting water flow, is passed from the inlet header 120 through the ducts $\mathbf{23}a_1,\mathbf{23}a_2, \ldots, \mathbf{23}a_n$ and further into respective mixer units $\mathbf{22}a_1,\mathbf{22}a_2, \ldots, \mathbf{22}a_n$. From the mixer units, in which the subcomponent flow $Q_1$ is mixed with the subcomponent flow $Q_2$, the combined flow is directed into the duct $\mathbf{25}a_1$ of the mixer unit and then into the distributor pipe/compartment $\mathbf{28}a_1,\mathbf{28}a_2$ . . . . From the distributor pipe/compartment $\mathbf{28}a_1,\mathbf{28}a_2$, the flow is passed through respective throttles $D_1,D_2$, . . . into turbulence tube $19a_2$ of the turbulence generator 19. The turbulence tube $19a_2$ carries the pulp therein, in a corresponding vertical height position, into the space between the flaps $16a_1$,$16a_2$ in the discharge duct 14.

Figure 2D:
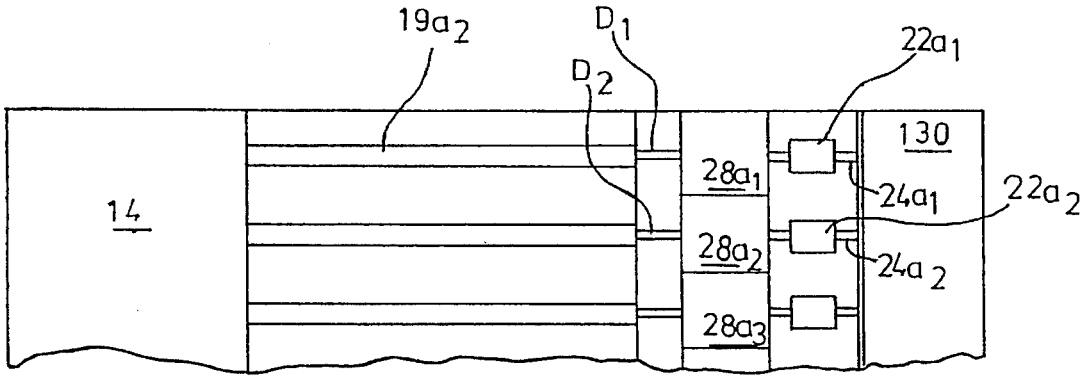
FIG. 2D is a sectional view taken along the line IV—IV in FIG. 1.

FIG. 2D is a sectional view taken along the line IV—IV in FIG. 1. As shown in FIG. 2D, the flow $Q_2$ is passed to the mixer units $22a_1$,$22a_2$, . . . , $22a_n$ from the inlet header 130. It is essential that the concentration of the subcomponent flow $Q_2$ differs from the concentration of the subcomponent flow $Q_1$. Preferably, the subcomponent flow $Q_1$ consists of diluting water, and the subcomponent flow $Q_2$ consists of pulp. From the inlet header 130, the subcomponent flow $Q_2$ is passed into the pipes $24a_1$,$24a_2$ . . . and into each particular mixer unit $22a_1$,$22a_2$ . . . , in which the subcomponent flows $Q_1$ and $Q_2$ are mixed at a certain mixing ratio. The combined subflow $Q_3$ is passed through the respective ducts $25a_1$,$25a_2$ . . . into the respective compartments $28a_1$,$28a_2$ of the distributor pipe and further through the throttles $D_1$,$D_2$ . . . into the turbulence generator 19 into each particular turbulence tube $19a_2$ and from there, into the discharge duct 14.

Figure 3:
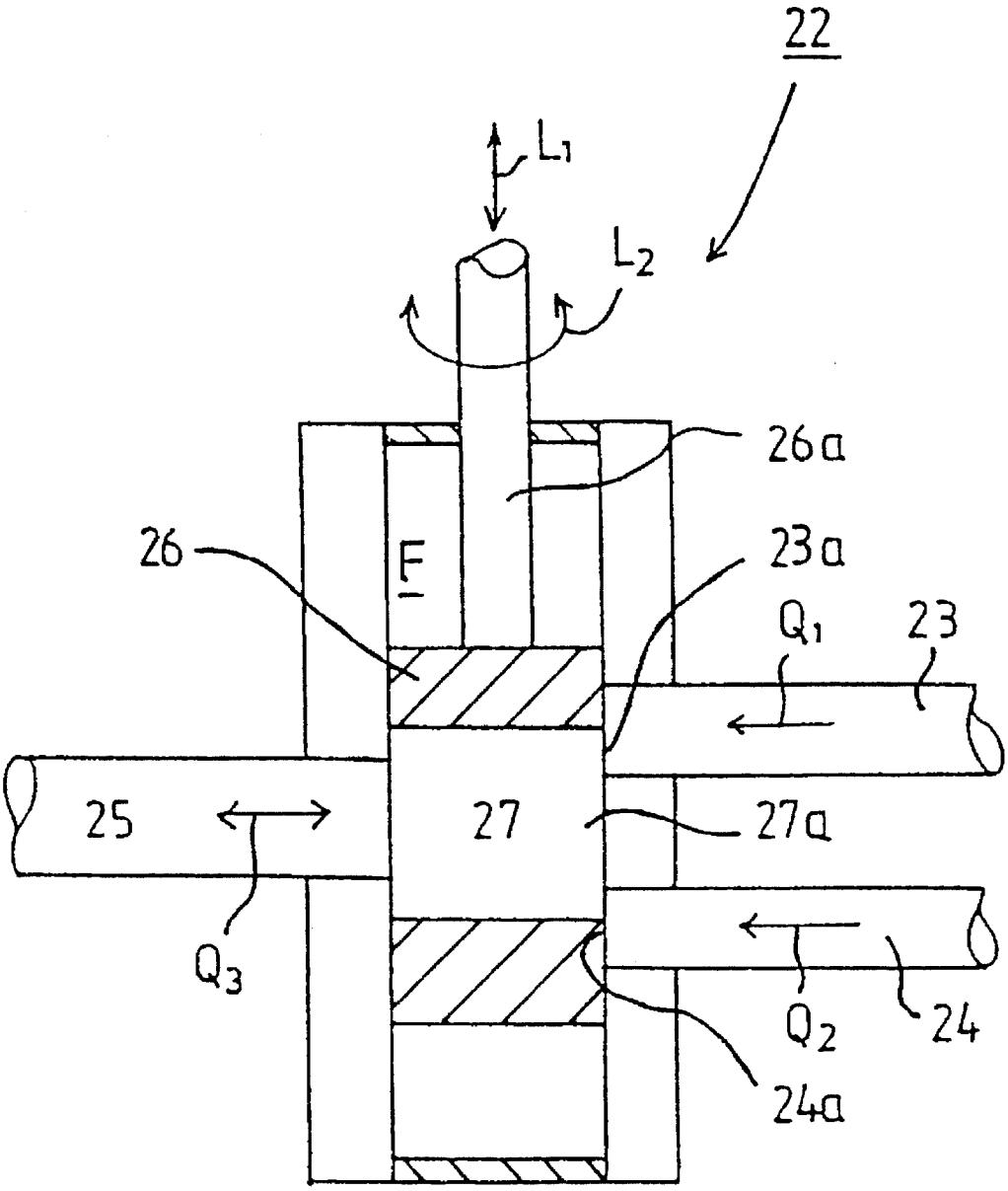
FIG. 3 is a partial illustration of principle of a mixer unit by whose means a fault in the grammage profile and a fault in the fiber orientation profile can be corrected locally in the direction of width of the web.

FIG. 3 is an illustration of principle of a mixer unit 22 in accordance with the invention by whose means it is possible to supply a pulp flow having a desired consistency to a certain pulp suspension layer and to a certain position of width of the multi-layer headbox. By means of the mixer unit shown in FIG. 3, it is possible to regulate the grammage profile. In a corresponding manner, by means of the mixer unit, it is possible to regulate the fiber orientation profile by acting upon the pressure loss in the pulp flow passing through the mixer unit and, thus, upon the velocity of the flow and the flow quantity.

FIG. 3 is an illustration of the principle involved in the operation of the mixer unit 22. The mixer unit 22 comprises a first inlet duct 23, through which the first subcomponent flow $Q_1$, preferably a so-called 0-water flow, is introduced into a chamber F of the mixer unit. Further, the mixer unit 22 comprises a second duct 24, through which the second subcomponent flow $Q_2$, which is preferably a subcomponent flow at the average concentration of the third pulp suspension component flow, is also introduced into the chamber F of the mixer unit 22. The flows pass, at the consistency ratio distributed by a distributor part 26 placed in the chamber F, through a transverse duct 27 of the distributor part 26 and into an outlet duct 25. The combined subflow $Q_3$ (the sum of the subcomponent flows $Q_1$+$Q_2$) is passed to a certain position along the width of the headbox of the paper machine. In accordance with the invention, each position of width of the paper machine comprises a separate duct $28a_1$,$28a_2$ . . . , in front of which there is a respective mixer unit $22a_1$,$22a_2$,$22a_3$ . . . , by whose means it is possible to regulate the concentration of the pulp suspension component flow departing from the mixer units at that position of width. In addition, it is also possible to regulate the flow velocity of the pulp suspension and, thus, the flow quantity or rate.

As shown in FIG. 3, the distributor part 26 can be displaced along a linear path (arrow $L_1$) in the chamber F, and the distributor part 26 can also be rotated (arrow $L_2$) in the chamber F. Upon rotation of the distributor part 26, a mouth part 27*a* of the flow duct 27 extending across the distributor part 26 can be brought into different positions in relation to the end openings 23*a*,24*a* of the inlet ducts 23 and 24. Thus, the subcomponent flows $Q_1$,$Q_2$ in the ducts 23 and 24 can be regulated by increasing the throttle, i.e. the flow resistance, of the subcomponent flow $Q_1$ in the duct 23 and reducing the throttle, i.e. the flow resistance, of the subcomponent flow $Q_2$ in the duct 24, or vice versa. This regulation is achieved because the size of the mouth part varies upon rotation of the distributor part 26. By shifting the distributor part 26 along a linear path, the mixing ratio of the component subflow $Q_3$ is affected and when the distributor part 26 is rotated, the pressure loss in the combined component subflow $Q_3$ is affected.

Figure 4A:
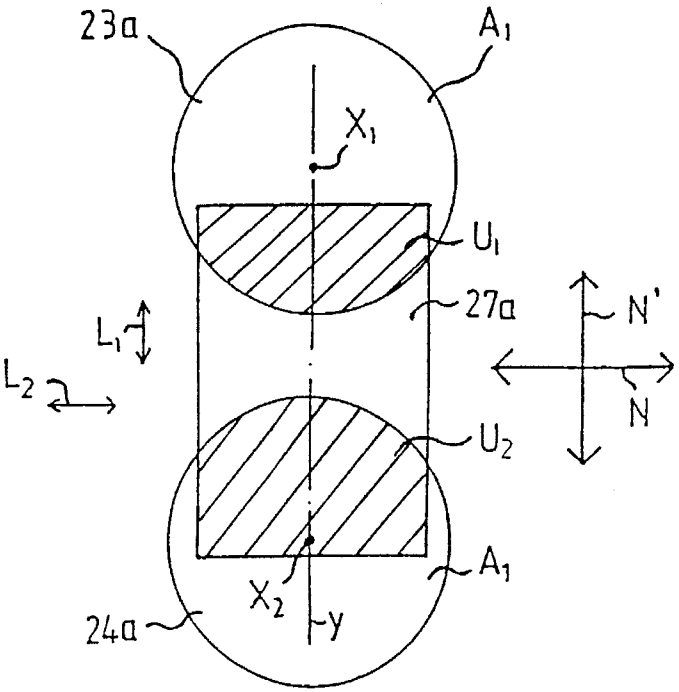
FIG. 4A is an illustration of principle of a first position of flow regulation.

FIG. 4A is an illustration of principle of a regulation in accordance with the invention. In the regulation position of FIG. 4A, the flow has access through the sectional flow areas $U_1$ and $U_2$ denoted by the shading into the duct 27 in the distributor part 26. The end opening of the duct 23 is denoted by 23*a*, and the end opening of the duct 24 is denoted by 24*a*. The sectional flow area of the end opening 23*a* is $A_1$, and it corresponds to the sectional flow area of the end opening 24*a* (provided ducts 23 and 24 have the same dimensions). The shapes of the openings 23*a* and 24*a* are similar to one another. The central axis of the opening 23*a* is denoted by $X_1$, and the central axis of the opening 24*a* is denoted by $X_2$. The connecting line of the axes $X_1$ and $X_2$ is denoted by Y. The orifice of the flow duct 27 in the regulation part 26 is denoted by 27*a* in the figure. When the overall flow quantity or rate $Q_3$ is desired to be increased, the sectional flow area $U_1$,$U_2$ is increased through which the flow takes place into the duct 27 in the regulation part 26 and (in the way shown in the figure) the distributor part 26 is raised or lowered perpendicularly to the line Y (in the direction N). In a corresponding manner, when only the mixing ratio of the subcomponent flows $Q_1$,$Q_2$ is desired to be changed, the orifice 27*a* is displaced in the direction N', which is perpendicular to the direction N. The flow openings 23*a*,24*a* are arranged in relation to one another that at least one of the central planes coincide and that at least one central planes perpendicular to the central planes are parallel to one another.

Figure 4B:
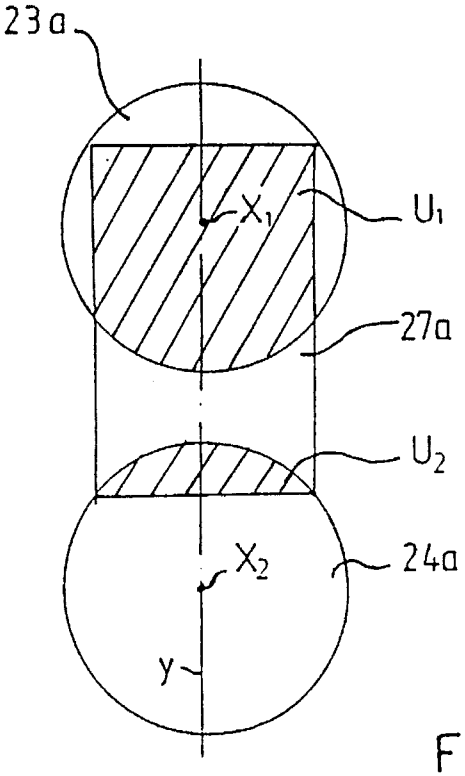
FIG. 4B shows a second position of flow regulation.
Figure 4C:
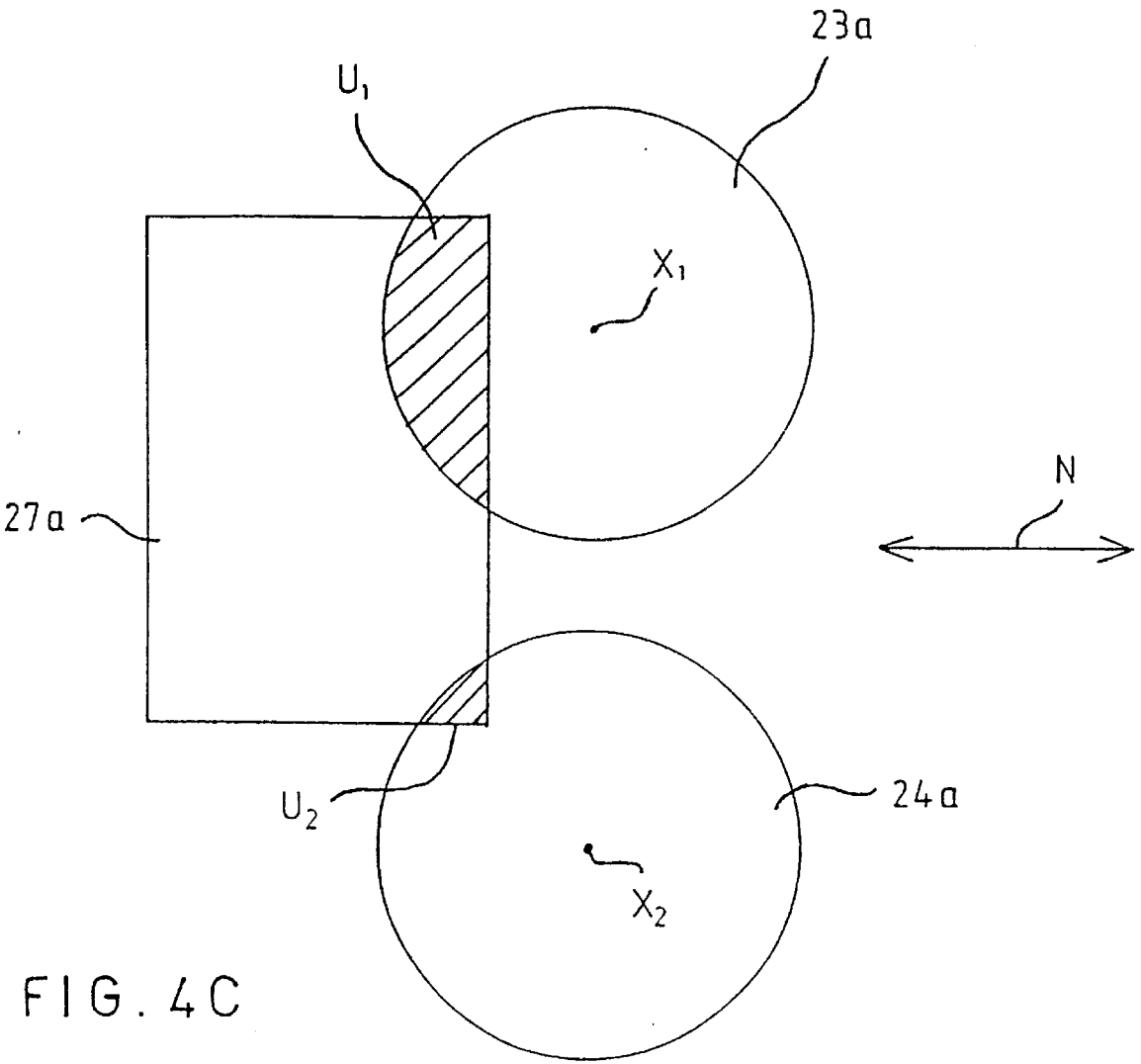
FIG. 4C shows a third position of flow regulation.

In FIGS. 4A, 4B and 4C, the regulation positions of the embodiment as shown in the embodiment of FIG. 3 is examined, wherein the distributor part includes a duct 27. It is noted though that the above examination also applies to the embodiment shown in FIG. 7, in which the distributor part 260 is a tumbler part, which does not include a separate transverse duct and by means of which tumbler part the end openings 23*a*,24*a* of the ducts 23,24 for the component flows are closed and opened.

When the distributor part 26 is shifted along a linear path in the manner shown in FIG. 4B, the sectional flow area $U_1$ of the subcomponent flow $Q_1$ coming from the duct 23 is increased, and the sectional flow area $U_2$ of the subcomponent flow $Q_2$ is reduced by a corresponding proportion. Thus, in the regulation, the mixing ratio is changed, but the sum of the flow quantities $Q_3$=$Q_1$+$Q_2$ remains invariable.

If it is desired to act upon the flow quantities of the flows $Q_3$ in the manner shown in FIG. 4C, the distributor part 26 is shifted to the side (arrow $L_2$) (e.g., by rotation), in which case, at the same time, the sectional flow areas $U_1$ and $U_2$ are reduced. When the sectional flow areas $U_1$,$U_2$ are increased, the mixing ratio must remain unchanged. If $U_1$ was, in the initial situation, larger than $U_2$, then in the new position, $U_1$ is increased by a larger amount than $U_2$. In a corresponding manner, when the sectional flow areas $U_1$ and $U_2$ are reduced, and if $U_1$ is larger than $U_2$, the reduction of $U_1$ must be greater than the reduction of $U_2$. The valve mechanism in accordance with the invention achieves the maintaining of the mixing ratio invariable in the regulation of the flow quantity while varying the quantity of the total flow. Thus, in the regulation of the flow quantity, when the distributor part 26 is rotated, the pressure loss of the flow is affected, and thereby the velocity profile of the flow and further the fiber orientation profile are affected. The regulation does not affect the concentration of the subflow $Q_3$, and thereby the concentration $D_3$ of the pulp suspension in the overall subflow $Q_3$ flowing out of the duct 25 is kept at its desired regulated value.

Figure 5A:
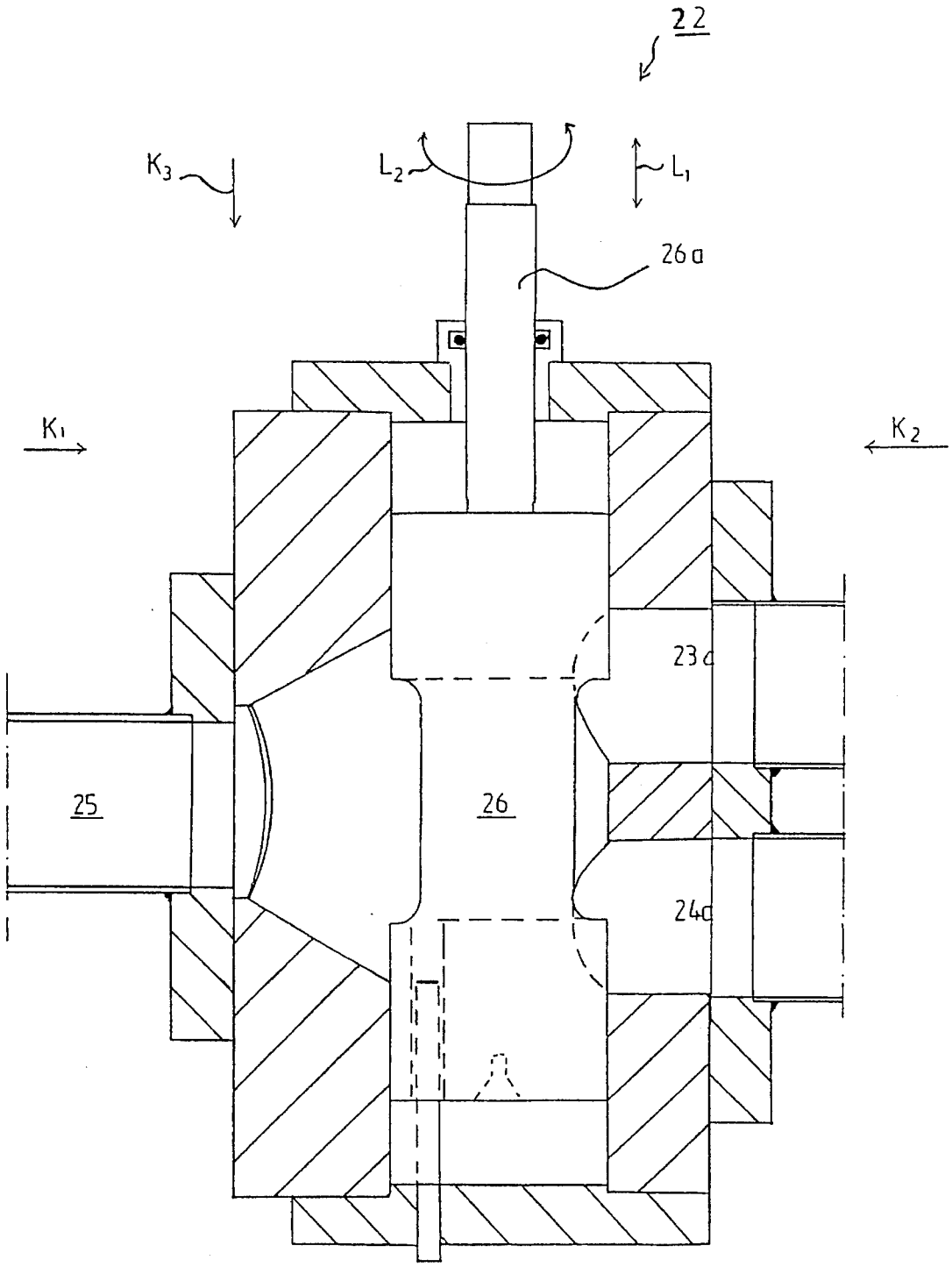
FIG. 5A is a sectional view of the mixer unit in accordance with the invention showing an embodiment of a mixer unit which corresponds to the illustrations of principle in FIG. 3 and in FIGS. 4A, 4B and 4C.

FIG. 5A is a sectional view of a first preferred embodiment of a mixer unit in accordance with the invention, which corresponds to the illustrations in FIGS. 3 and 4A, 4B and 4C. As described above, the mixer unit 22 comprises a first inlet duct 23 and a second inlet duct 24 as well as an exhaust or outlet duct 25. The mixer unit also comprises a chamber F in which the distributor part 26 is fitted to be displaceable along a linear path (arrow $L_1$) and in which it is fitted to be rotatable (arrow $L_2$).

When the distributor part 26 is displaced along a linear path perpendicularly to the inlet axes $X_1$,$X_2$ and $X_3$ of the ducts 23,24,25 (arrow $L_1$), respectively, the position of the inlet opening 27*a* of the transverse duct 27 in the distributor part 26 in relation to the end opening 23*a* of the first inlet duct 23 and to the end opening 24*a* of the second inlet duct 24 is affected. Thus, when the distributor part 26 is raised or lowered (arrow $L_1$), the flow is increased through the first inlet duct 23 into the transverse duct 27 in the distributor part 26, and the flow through the second inlet duct 24 is reduced by a corresponding amount, and vice versa. Thus, the mixing ratio between the subcomponent flow $Q_1$ coming from the inlet duct 23 and the subcomponent flow $Q_2$ coming from the other inlet duct 24 is changed, but the overall subflow quantity $Q_3$ of the subcomponent flows $Q_1$,$Q_2$ through the outlet duct 25 ($Q_3=Q_1+Q_2$) is kept invariable.

Out of the first inlet duct 23, preferably 0-water is made to flow. Out of the inlet duct 23, it is also possible to pass a pulp suspension whose concentration is, on the whole, different from the average concentration of the pulp suspension in the headbox, while the pulp having an average concentration is made to flow preferably through the second inlet duct 24.

When the distributor part 26 is rotated (arrow $L_2$), at the same time the throttle of the subcomponent flow $Q_1$ coming out of the first inlet duct 23 and the throttle of the subcomponent flow $Q_2$ coming out of the second inlet duct 24 are affected so that the flow resistances of the flows out of the ducts 23 and 24 are increased or reduced simultaneously. Thus, by rotating the distributor part 26, the pressure loss of the combined flow $Q_3=Q_1+Q_2$ is affected. When the pressure loss is increased or reduced, the flow quantity of the subflow $Q_3$ through the outlet duct 25 is increased or reduced. In this manner, it is possible to affect the velocity profile of the flow and further the pulp fiber orientation profile at the desired position along the width of the paper machine in the desired way.

Figure 5B:
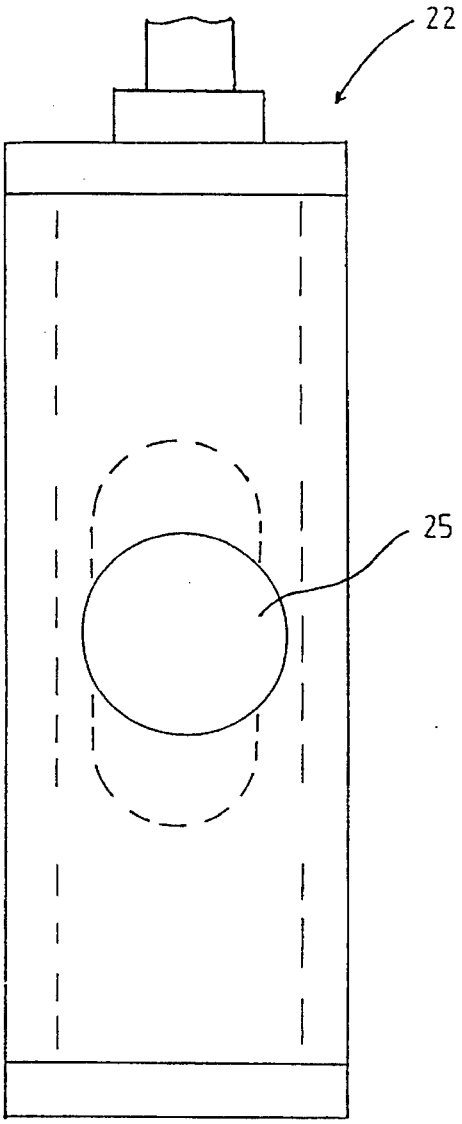
FIG. 5B is an illustration in the direction $K_1$ indicated in FIG. 5A.
Figure 5C:
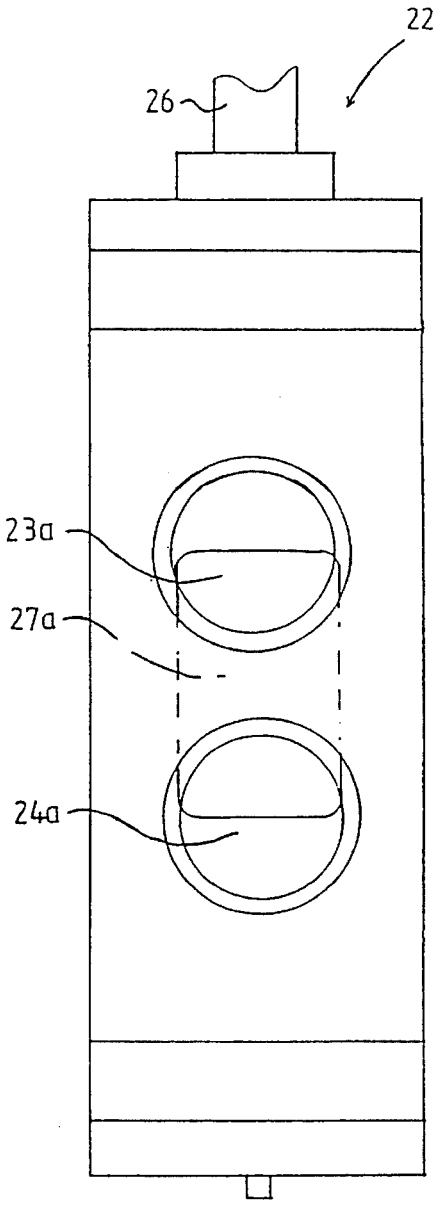
FIG. 5C is an illustration in the direction $K_2$ indicated in FIG. 5A.
Figure 5D:
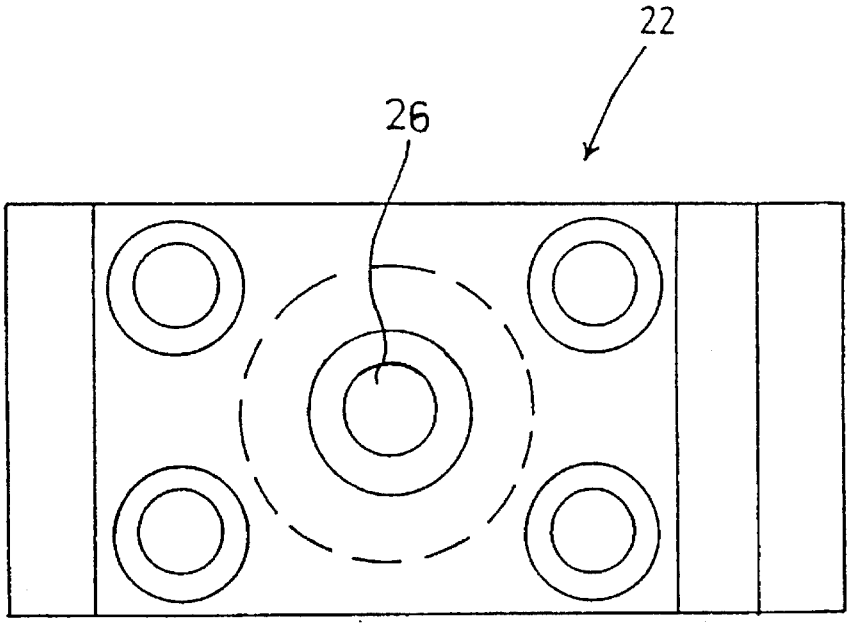
FIG. 5D is an illustration in the direction $K_3$ indicated in FIG. 5A.

The structure of the first preferred embodiment of the mixer unit shown in FIG. 5A is shown in more detail in FIG. 5B, which is illustration in the direction $K_1$ indicated in FIG. 5A, FIG. 5C which is an illustration in the direction $K_2$ indicated in FIG. 5A, and FIG. 5D, which is an illustration in the direction $K_3$ in FIG. 5A, i.e. from above.

Figure 5E:
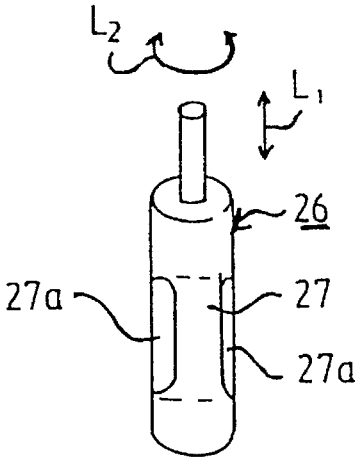
FIG. 5E is an axonometric view of the distributor part of the mixer unit shown in FIGS. 5A–5D.

FIG. 5E is an axonometric illustration of a disassembled distributor part 26 of the mixer unit 22 in accordance with the invention.

Figure 6A:
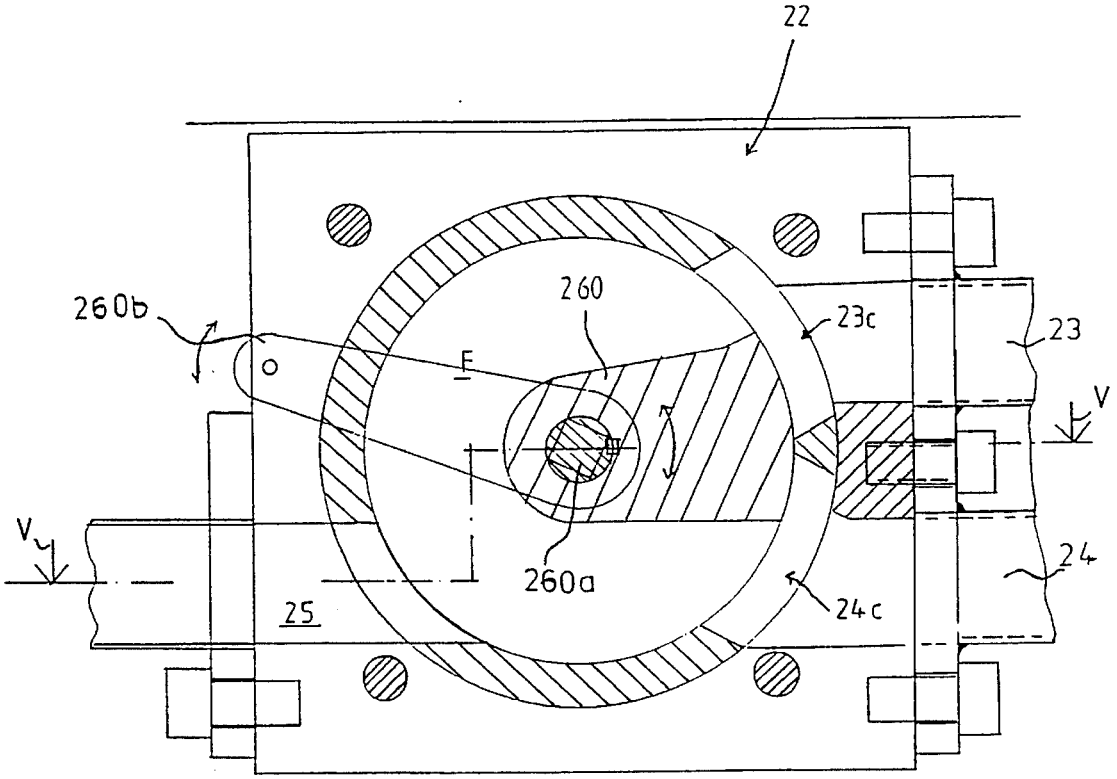
FIG. 6A is a sectional view of a second embodiment of the mixer unit in accordance with the invention, wherein the flow into the inlet chamber of the mixer unit is distributed by means of a separate tumbler piece which is placed in different closing positions in relation to the inlet openings, in which case, when one inlet opening is being opened, the other inlet opening is closed by a corresponding amount.

FIG. 6A is a sectional view of a second embodiment of the mixer unit 22 in accordance with the invention. Also in this embodiment, the mixer unit 22 comprises a first inlet duct 23 and a second inlet duct 24 and an exhaust or outlet duct 25 through which the combined flow $Q_3=Q_1+Q_2$ is removed. A distributor part 260 is arranged in the mixer unit 22 and comprises a displacing spindle 260*a*, by whose means the distributor part 260 can be shifted into different covering positions in relation to the end opening 23*a* of the first inlet duct 23 and in relation to the end opening 24*a* of the second inlet duct 24. Through the first inlet duct 23, preferably 0-water is introduced. It is also possible to make such a pulp suspension flow through the duct 23 whose concentration is, on the whole, different from the average concentration of the pulp suspension in the headbox. However, the pulp suspension having an average concentration is made to flow preferably through the second inlet duct 24. Thus, in the manner shown in FIG. 6A, when the spindle 260*a* is rotated (arrow $L_3$), the distributor part 260, which operates as a tumbler part, is shifted into different covering positions in relation to the end openings 23*a*,24*a*. When the distributor part 260 is displaced, the end opening 23*a* of the inlet duct 23 is opened, and the end opening 24*b* of the inlet duct 24 is closed by the corresponding amount, and vice versa. As a result, in this embodiment, as in the embodiment shown in FIG. 5, the mixing ratio can be continuously regulated and, yet, the flow quantity of the combined subflow $Q_3$ remains invariable, i.e. the pressure loss remains at its invariable value.

The duct 24 is passed to, leads to, the desired position of width of the headbox of the paper machine. In the direction of width, the headbox of the paper machine comprises a number of ducts 25*a*$_1$,25*a*$_2$ . . . , which are opened preferably into separate distribution pipes 28*a*$_1$,28*a*$_2$ . . . , each of which passes directly into a turbulence tube 19*a*$_1$,19*a*$_2$ . . . of its own placed in the same position of width in the turbulence generator 19.

Figure 6B:
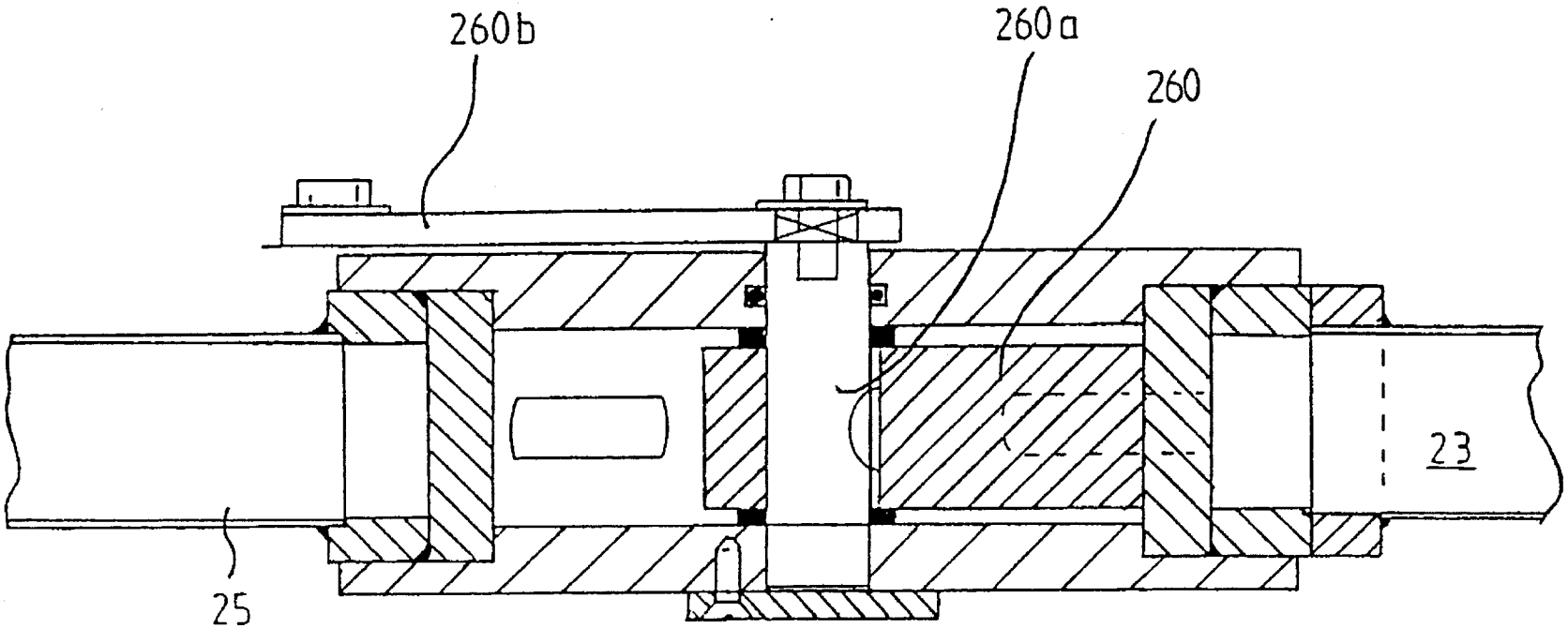
FIG. 6B is a sectional view taken along the line V—V in FIG. 6A.

FIG. 6B is a sectional view taken along the line V—V in FIG. 6A. The spindle 260*a* is rotated by means of the lever 260*b*.

Figure 7A:
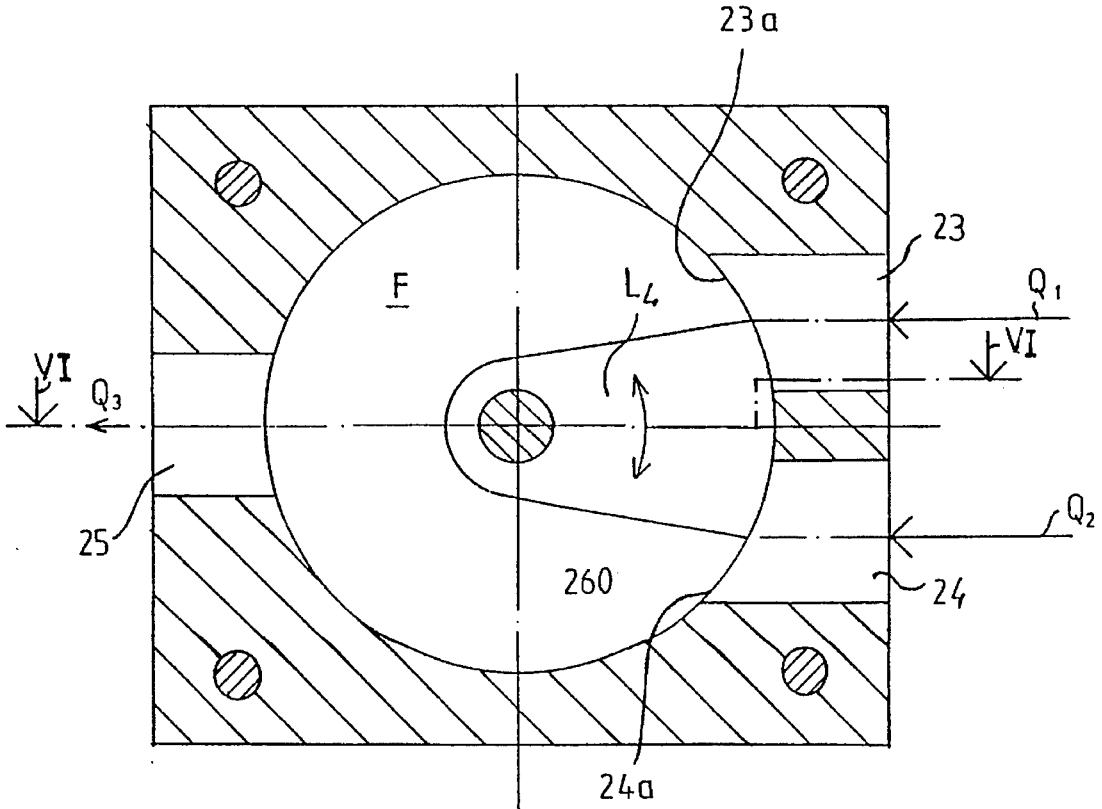
FIG. 7A shows an embodiment of the invention in other respects corresponding to FIGS. 6A,6B, except that in this embodiment the pressure level of the departing flow can also be regulated.

FIG. 7A shows an embodiment of the invention which is in some respects similar to the embodiment of FIGS. 6A and 6B. However, in the embodiment shown in FIG. 7A, the flow quantity of the departing flow can also be regulated so that the mixing ratio remains at a regulated invariable value. In the embodiment of FIG. 7A, the spindle 260*a* is displaced along a linear path as indicated by the arrow $L_5$ in which case the distributor part 260 connected with the spindle is placed in different covering positions in relation to the end openings 23*a*,24*a* so that, at the same time, the end openings 23*a*,24*a* are closed or opened. The regulation of the mixing ratio takes place so that the spindle 260 is rotated (arrow $L_4$), whereby the distributor part 260 is shifted into different covering positions in relation to the end openings 23*a*,24*a*, and so that, when the sectional flow area of one end opening is increased, the sectional flow area of the other opening is reduced by the corresponding amount, and vice versa.

Figure 7B:
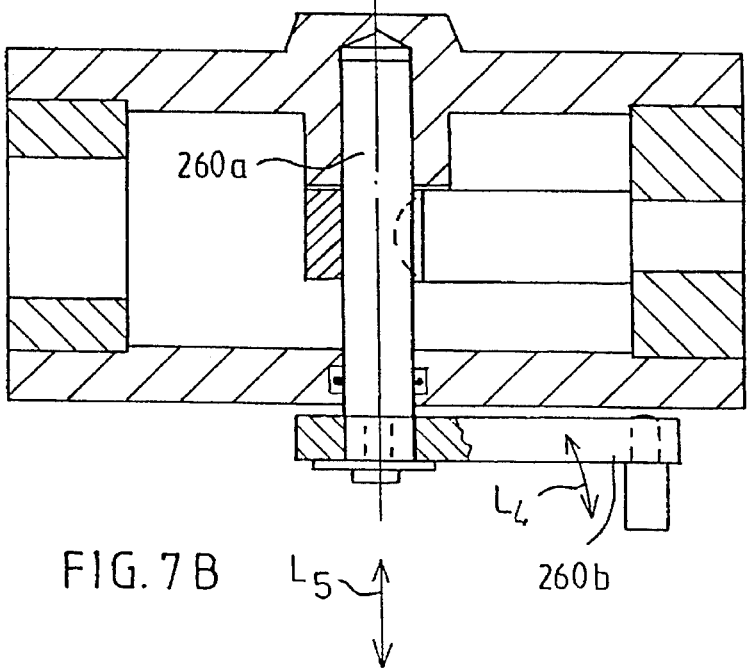
FIG. 7B is a sectional view taken along the line VI—VI in FIG. 7A.

FIG. 7B is a sectional view taken along the line VI—VI in FIG. 7A. In the manner indicated in FIG. 7B, by means of the arrow $L_5$, the distributor part 260 can be shifted along a linear path, whereby, at the same time, the end openings of the ducts 23 and 24 are opened or closed, in which case the throttle of the outlet subflow $Q_3$ is reduced or increased while the mixing ratio of the subcomponent flows $Q_1$ and $Q_2$ remains at its invariable value.

The examples provided above are not meant to be exclusive. Many other variations of the present invention would be obvious to those skilled in the art, and are contemplated to be within the scope of the appended claims.

We claim:

1. A method for regulating a total pulp flow from a headbox, comprising the steps of:

passing at least a first, second and third component flow having certain pulp properties from said headbox to form a first, second and third layer of a web, respectively, said second component flow being situated intermediate of said first and third component flows, and regulating the pulp properties of said second component flow in a direction transverse to the direction of said second component flow to provide different pulp properties at different locations in the transverse direction of said second component flow without regulating the pulp properties of said first and third component flows in a direction transverse to the direction of said first and third component flows, respectively, the pulp properties of said second component flow being regulated by forming said second component flow from a plurality of component subflows arranged in the transverse direction of said headbox, regulating the rate of at least one of said component subflows, and regulating the concentration of said at least one of said component subflows independently from the regulation of the rate of said at least one of said component subflows, whereby the pulp properties of the total headbox pulp flow is regulated.

2. The method of claim 1, further comprising the steps of:

forming each of said component subflows from a first subcomponent flow and a second subcomponent flow, passing said first and second subcomponent flows through inlet ducts into a respective mixer unit, mixing said first and second subcomponent flows in said mixer units to form said component subflows, and maintaining the rate of each of said component subflows constant by regulating the rate of said first subcomponent flow relative to said second subcomponent flow such that when the rate said first subcomponent flow is increased, the rate of said second subcomponent flow is reduced by a corresponding amount.

3. The method of claim 1, further comprising the steps of:

forming each of said component subflows from a first subcomponent flow and a second subcomponent flow, combining respective ones of said first and second subcomponent flows in a certain mixing ratio to form said component subflows, and maintaining the mixing ratio substantially constant by increasing or reducing both said first and second subcomponent flows simultaneously to thereby regulate the rate of said component subflows.

4. The method of claim 1, further comprising the steps of:

forming each of said component subflows from a first subcomponent flow and a second subcomponent flow, providing said first subcomponent flow as a pulp flow having a first concentration, and providing said second subcomponent flow with a second concentration different than said first concentration of said first subcomponent flow.

5. The method of claim 1, further comprising the steps of:

forming each of said component subflows from a first subcomponent flow and a second subcomponent flow, combining said first and second subcomponent flows in a mixer unit in a certain mixing ratio to form said component subflows, said mixer unit having a chamber and a displaceable distributor part arranged therein, said mixer unit causing flow resistance to said first and second subcomponent flows, and regulating the mixing ratio by displacing said distributor part in said chamber to increase the flow resistance of said first subcomponent flow and reduce the flow resistance of said second subcomponent flow by a corresponding amount to thereby regulate the concentration of said component flows.

6. The method of claim 5, further comprising the steps of:

directing said first and second subcomponent flows through end openings of respective inlet ducts into said chamber, said distributor part having a duct alignable with said end openings, and displacing said distributor part to move said duct into different positions in relation to said end openings and thereby determine the flow resistance of said first and second subcomponent flows into said mixer unit.

7. The method of claim 1, further comprising the steps of:

forming each of said component subflows from a first subcomponent flow and a second subcomponent flow, directing said first and second subcomponent flows through end openings of respective inlet ducts into a chamber of a mixer unit to form said component flows, said mixer unit having a distributor part arranged in said chamber, and moving said distributor part into different covering positions to close and to open said end openings of said inlet ducts.

8. The method of claim 7, further comprising the steps of:

connecting a spindle to said distributor part, and rotating said distributor part by means of said spindle.

9. The method of claim 7, wherein said mixer unit provides flow resistance to said first and second subcomponent flows, further comprising the steps of:

combining said first and second subcomponent flows in a certain mixing ratio in said mixer unit, maintaining the mixing ratio substantially constant, and regulating the total flow rate of said subcomponent flows by shifting said distributor part to increase or reduce the flow resistances of both of said first and second subcomponent flows.

10. The method of claim 7, further comprising the steps of:

combining said first and second subcomponent flows in a certain mixing ratio in said mixer unit, regulating the total flow rate of said subcomponent flows by displacing said distributor part in a direction perpendicular to a line connecting central axes of said end openings, and regulating the mixing ratio by shifting said distributor part in a direction perpendicular to the direction of displacement.

11. The method of claim 1, further comprising the step of independently regulating each of said component subflows.

12. In a multi-layer headbox for forming a total pulp flow, said headbox including an inlet header, distributor pipes, a turbulence generator and a discharge duct, means for passing a first pulp suspension component flow from said inlet header into said distributor pipes, through said distributor pipes into said turbulence generator and further into said discharge duct, said first pulp suspension component flow being discharged from said discharge duct and forming a first layer of a web, means for passing a second pulp suspension component flow into said turbulence generator and then into said discharge duct to combine with said first pulp suspension component flow, said second pulp suspension component flow being discharged from said discharge duct and forming a second layer of the web, and means for passing a third pulp suspension component flow from said inlet header into said distributor pipes, through said distributor pipes into said turbulence generator and further into said discharge duct to combine with said first and second pulp suspension component flows, said third pulp suspension component flow being discharged from said discharge duct and forming a third layer of the web, said second pulp suspension component flow being situated intermediate of said first and third pulp suspension component flow, the improvement comprising;

means for introducing a plurality of adjacent second component subflows at different points in a transverse direction of said second pulp suspension component flow to form said second pulp suspension component flow, said introducing means comprising a first and second medium source for providing first and second subcomponent flows, respectively, for each of said adjacent second component subflows, and regulating means for providing different pulp properties of said second pulp suspension component flow at said points by independently regulating the rate and concentration of each of said plurality of adjacent second component subflows such that the total headbox pulp flow is regulatable by means of the regulation of said second pulp suspension component flow without regulating said first and third suspension component flows, respectively, said regulating means comprising a mixer unit for combining respective ones of said first and second subcomponent flows, such that for a constant second component subflow, said first subcomponent flow is increased and said second subcomponent flow is reduced by a corresponding amount.

13. The multi-layer headbox of claim 12, wherein said first and second sources are inlet headers.

14. The multi-layer headbox of claim 12, further comprising additional distributor pipes positioned and arranged for passing said second component subflows to said turbulence generator, said additional distributor pipes being arranged at substantially the same level, and said regulating means regulating the combining of respective ones of said first and second subcomponent flows.

15. The multi-layer headbox of claim 12, further comprising a plurality of said mixer units, one for each of said plurality of adjacent second component subflows, each of said mixer units comprising a chamber and a displaceable distributor part arranged in said chamber, and inlet ducts having end openings through which said first and second subcomponent flows are directed into said chamber in a respective one of said mixer units, said distributor part being displacable into different covering positions in relation to said end openings to define a throttle of said first and second subcomponent flows for regulating the rate and concentration of said second component subflow to a desired level, such that upon displacement of said distributor part, the throttle of said first subcomponent flow is increased, and the throttle of said second subcomponent flow is reduced by a corresponding amount.

16. The multi-layer headbox of claim 15, wherein said distributor part comprises a duct having a mouth opening, said mouth opening being moved upon displacement of said distributor part into different positions in relation to said end openings of said inlet ducts.

17. The multi-layer headbox of claim 15, wherein said distributor part comprises a displaceable tumbler part, said tumbler part being displaceable into different covering positions in relation to said end openings of said inlet ducts.

18. The multi-layer headbox of claim 15, wherein said distributor part comprises a shifting spindle for displacing said distributor part.

19. The multi-layer headbox of claim 15, wherein said distributor part is displacable along a linear path and rotated, such that upon displacement of said distributor part in a direction perpendicular to a line connecting central axes of said end openings of said inlet ducts, the flow rate of said second component subflow is regulatable to a desired level by simultaneously increasing or reducing the throttle of respective said first and second subcomponent flows, and such that for a certain mixing ratio, the pressure loss and thus the flow rate of said second component subflow is regulatable, the profile of the velocity of said second pulp suspension component flow also being regulated to thereby control the profile of the fiber orientation.

20. The multi-layer headbox of claim 12, further comprising a plurality of said mixer units, one for each of said plurality of adjacent second component subflows, each of said mixer units comprising a substantially cylindrical chamber and a displaceable distributor part arranged in said chamber, said distributor part being cylindrical and rotatable about a central axis thereof to regulate the rate of said first and second component flows flowing into said chamber, said distributor part being displaceable along said axis to regulate the concentration of said first and second component flows flowing into said chamber.

* * * * *